US009822534B2

(12) United States Patent
Dingler

(10) Patent No.: US 9,822,534 B2
(45) Date of Patent: Nov. 21, 2017

(54) CONCRETE FORM HAVING ATTACHMENT DEVICE FOR ANCHOR ROD

(71) Applicant: MEVA Schalungs-Systeme GMBH, Haiterbach (DE)

(72) Inventor: Gerhard Dingler, Haiterbach (DE)

(73) Assignee: MEVA Schalungs-Systeme GmbH, Haiterbach (DE)

( * ) Notice: Subject to any disclaimer, the term of this patent is extended or adjusted under 35 U.S.C. 154(b) by 0 days.

(21) Appl. No.: 15/173,862

(22) Filed: Jun. 6, 2016

(65) Prior Publication Data

US 2017/0002575 A1 Jan. 5, 2017

(30) Foreign Application Priority Data

Jul. 3, 2015 (EP) ..... 15175229

(51) Int. Cl.

| | |
|---|---|
| ***E04G 17/065*** | (2006.01) |
| ***E04G 17/075*** | (2006.01) |
| ***E04G 17/14*** | (2006.01) |
| *E04G 9/02* | (2006.01) |

(52) U.S. Cl.

CPC ..... *E04G 17/065* (2013.01); *E04G 17/075* (2013.01); *E04G 17/14* (2013.01); *E04G 2009/028* (2013.01)

(58) Field of Classification Search

CPC ..... E04G 17/14; E04G 17/065; E04G 17/075; E04G 17/06; E04G 2017/0601; E04G 2017/0603; E04G 2017/0605; E04G 2017/0614; E04G 2017/0616; E04G 2017/0618; E04G 2017/0627; E04G 2017/0629; E04G 2017/0631; E04G 17/0651; E04G 17/0652; E04G 17/07; E04G 17/0707; E04G 17/0714; E04G 17/0751; E04G 17/0752

USPC ..... 249/40, 42, 46, 190

See application file for complete search history.

(56) References Cited

U.S. PATENT DOCUMENTS

| | | | | |
|---|---|---|---|---|
| 1,424,880 A * | 8/1922 | Colt | E04G 17/07 24/19 |
| 1,567,210 A * | 12/1925 | Trester | E04G 17/07 140/123.5 |
| 1,851,678 A * | 3/1932 | Mayer | E04G 17/07 24/523 |

(Continued)

FOREIGN PATENT DOCUMENTS

| | | |
|---|---|---|
| DE | 1269327 | 5/1968 |
| DE | 10336414 A1 | 3/2005 |

(Continued)

*Primary Examiner* — Michael Safavi
(74) *Attorney, Agent, or Firm* — Von Rohrscheidt Patents

(57) ABSTRACT

The invention relates to a casing shell element for casing concrete and proposes a rotatable anchor counter piece for anchoring wherein the anchor counter piece includes two pass through holes intersecting each other which are optionally alignable with an anchor hole in a casing shell of the casing shell element for inserting an anchor by rotating the anchor counter piece. A pass through hole includes an internal thread for threading in a non-illustrated anchor and another pass through hole is configured without a thread for inserting an anchor onto which a non illustrated anchor nut is threaded for attachment purposes.

4 Claims, 7 Drawing Sheets

(56) References Cited

U.S. PATENT DOCUMENTS 2,133,574 A * 10/1938 Roemisch ..... E04G 17/0752 249/213
2,162,349 A * 6/1939 Hillberg ..... E04G 17/0707 24/268
2,190,838 A * 2/1940 Hillberg ..... E04G 17/065 24/115 G
2,358,975 A * 9/1944 Hillberg ..... E04G 17/0721 249/190
2,395,204 A * 2/1946 Symons ..... E04G 17/0754 24/135 N
2,579,650 A * 12/1951 Corcoran ..... E04G 17/0751 24/569
3,057,034 A * 10/1962 Helmick ..... E04G 17/0714 249/213
3,204,918 A * 9/1965 Bonin ..... E04G 11/10 249/191
3,482,813 A * 12/1969 Wells ..... E04G 17/0721 249/217
3,625,471 A * 12/1971 Eriksson ..... E04G 17/07 249/219.2
3,690,613 A * 9/1972 Shoemaker ..... E04G 17/0721 249/40
3,693,931 A * 9/1972 Holt ..... E04G 17/0721 249/219.2
3,767,158 A * 10/1973 Mikus ..... E04G 17/001 249/148
3,881,684 A * 5/1975 Daniels, Jr. ..... E04G 17/0721 249/214
3,927,856 A * 12/1975 Lovisa ..... E04G 17/0714 249/177
3,981,476 A * 9/1976 Alexander ..... E04G 17/0658 249/217
4,177,968 A * 12/1979 Chapman ..... E04C 3/07 249/211
4,231,541 A * 11/1980 Strickland ..... E04G 17/0714 249/216
4,899,978 A * 2/1990 Gates ..... E04G 17/0754 249/219.2
4,964,747 A * 10/1990 Vinson ..... E04G 17/065 256/37
5,137,250 A * 8/1992 McCracken ..... E04G 17/065 249/219.2
5,255,488 A * 10/1993 Johnson ..... E04G 17/0754 249/216
6,237,890 B1 * 5/2001 Gates ..... E04G 11/12 249/219.1
6,254,056 B1 * 7/2001 Alfred ..... E04G 17/0707 249/219.1
8,272,620 B2 * 9/2012 Schwoerer ..... E04G 17/0752 249/190
2015/0152909 A1 * 6/2015 Berger ..... E04G 17/0652 411/133
2015/0167329 A1 * 6/2015 Hagemes ..... E04G 17/0652 52/745.21

FOREIGN PATENT DOCUMENTS

DE 102010002108 A1 8/2011
WO WO2007058491 A1 5/2007

* cited by examiner

CONCRETE FORM HAVING ATTACHMENT DEVICE FOR ANCHOR ROD

RELATED APPLICATIONS

This application claims priority from and incorporates by reference European Patent Application 15 175 229.2 filed on Jul. 3, 2015.

FIELD OF THE INVENTION

The instant invention relates to a casing shell element. The casing shell element is used for fabricating casings for casting concrete for construction, in particular for casing concrete walls. The casing shell element includes a frame at which a casing shell is attached. The casing shell is typically a plate made from wood or plastic material. The frame is used for stiffening the casing shell, for arranging supports at the casing shell element and/or for connecting with additional casing shell elements.

BACKGROUND OF THE INVENTION

Casing shell elements of this general type are known. For so called double head casings where two casing shell elements are arranged at a distance from each other so that concrete can be cast between the opposite casing shell elements, for example for building a concrete will the casing shell elements that are arranged opposite to each other, are connected with each other by rods which are designated as anchors. The anchors reach through the anchor holes in the casing shell of the casing shell elements and are for example attached with nuts at a back side of the frame. The back side is a side of the casing shell element that, is oriented away from the casing shell.

BRIEF SUMMARY OF THE INVENTION

Thus, it is an object of the invention to propose a casing shell element which facilitates different attachments of anchors or the attachment of different anchors.

This object is achieved according to the invention by a casing shell element for casing concrete, the casing shell element including a casing shell which is arranged at a frame and which includes an anchor hole configured for inserting an anchor, and an attachment device providing a disengageable and tension proof connection of the anchor with the casing shell element, wherein the attachment device is movably attached at the casing shell element and includes at least one attachment facility for the anchor, wherein the at least one attachment facility is movable into an operating position by moving the attachment device, and wherein the anchor is connectable through the anchor hole in a disengageable manner with the attachment device in the operating position of the attachment facility.

Attachment facilities of this type can be interior threads for threading in an anchor, pass through holes or other devices or options for a friction locking and/or form locking attachment of an anchor at the casing shell element. In particular the at least one attachment facility includes an internal thread for threading in an anchor that includes a thread, for example a Dywidag-rod. The attachment device is used for a disengageable tension proof connection of an anchor with the casing shell element. Through the movability at the casing shell element the attachment device can be moved into an operating position in which an anchor is connectable in a disengageable manner with the at least one attachment facility through an anchor hole in the casing shell. In embodiments of the invention it is possible to move the attachment device sideways which attachment device is movably attached at the casing shell element, so that an anchor is insertable through the anchor hole and attachable bypassing the attachment device for example by an anchor nut at a back side of the casing shell element. Moving sideways means that the attachment device is movable into an operational position in which it does not cover the anchor hole in the casing shell so that an anchor is insertable through the anchor hole in the casing shell past the attachment device. Sideways can also mean in upward direction or in downward direction.

An embodiment of the invention provides that the attachment device has plural attachment facilities for different anchors. The movability at the casing shell element facilitates moving the attachment device into an operating position in which an anchor is optionally connectable with one of the attachment facilities through an anchor hole in the casing shell. The attachment device includes an operating position for each attachment facility and is moved into the operating position of the selected attachment facility by moving the attachment device at the casing shell element. This embodiment of the invention does not preclude that the attachment device is also movable sideways so that an anchor is insertable through the anchor hole in the casing shell bypassing the attachment device.

Tension proof with respect to the anchor means that the anchor is connected or connectable with the casing shell element so that it is loadable with tension. This does not preclude a connection that is fixated in another direction, for example a connection that is compression proof or shear proof or pivot proof. In order to compensate angular misalignments the connection can be pivotable or allowing pivoting the anchor.

Moveably, for example rotate ably or pivot able does not only mean a move ability of the attachment device overall relative to the casing shell element but also includes a move ability of the portion of the attachment device, for example of an anchor counter piece.

It is an advantage of the invention that different anchors can be attached at the casing shell element. The invention also facilitates embodiments for optional unilateral or two sided anchoring. In a two sided anchor nuts are threaded onto the anchor at back sides that are oriented away from each other of casing shell elements of a double head casing that are oriented opposite to each other at a distance, thus the anchor can be loaded at both casing shell elements by rotating the anchor nuts. For one sided anchoring the anchor is fixated at one casing shell element at least in a tension direction and has to be loaded at another opposite casing shell element. This requires different attachment facilities for the anchor at the opposite casing shell elements for example a pass through hole at one casing shell element and an internal thread at the other casing shell element. This is facilitated by the invention, wherein the choice of the attachment facilities is still possible any time by moving the attachment device even after the casing shell has been set up. It is another advantage of the invention that the attachment device is arranged at the casing shell element and that it is not a separate component.

One embodiment of the invention provides a position securing device which supports the attachment device in at least one operating position. The position securing device can function self-acting or can be actuatable manually or in another manner. The position securing device prevents unintentional or gravity induced movement of the attachment device from a selected operating position and facilitates intentional movement of the attachment device from one operating position into another operating position. One option of a position securing device is a snap locking device which snap locks in the at least one operating position of the attachment device and which can be unlocked by a force in movement direction to move the attachment device into another operating position. A snap locking device functions self-acting. Another option of a position securing device is a manually operable dead bolt or a similar locking element which supports the attachment device in the operating positions. The enumeration is exemplary and not exclusive.

Advantageously the attachment device is pivotably attached at the casing shell element. One embodiment provides that the attachment device includes intersecting attachment facilities which intersect a pivot axis about which the attachment device is pivot able. Pivoting the attachment device about its pivot axis facilitates moving a desired attachment facility of the attachment device into the operating position.

Another embodiment of the invention provides that the attachment device is movably attached at the casing shell element. An attachment device can include plural attachment facilities. An embodiment with plural movable attachment devices respectively including one or plural attachment facilities is also conceivable. Moving the attachment devices facilitates moving one attachment facility into the operating position.

In particular the attachment device includes an attachment facility with an interior thread for threading in an anchor with a thread and an attachment facility without a thread for passing an anchor through. Other attachment facilities are not excluded.

Advantageously the attachment device does not protrude beyond the frame at a back side of the casing shell element. This facilitates storing and transporting casing shell elements in contact with each other and thus in a space saving manner. Advantageously the attachment device does not protrude beyond the casing shell element at sides so that two casing shell elements can be arranged in contact with each other adjacent to each other or on top of each other.

An embodiment of the invention provides that the attachment device is arranged at one side of a strut of the frame of the casing shell element. This facilitates a stable attachment of the attachment device at the casing shell element. One embodiment provides an attachment of the attachment device in an intermediary space between two struts of a double strut of the frame of the casing shell element. Two parallel struts are designated as a double strut wherein a distance of the strut from each other is not more than a width or twice or three times a width of the struts. This embodiment of the invention facilitates a stable and space saving attachment of the attachment device at the casing shell element.

An alternative embodiment of the invention facilitates arranging the attachment device in a strut of the frame of the casing shell element. Since the struts of the frames of casing shell elements typically are rectangular tubes this is possible. Also in other profiles, for example in U-profiles configured as struts it is feasible without any problem to house the attachment device. Arranging the attachment device in one strut of the frame is mechanically stable, does not use any space outside of the strut and protects the attachment device against contamination.

BRIEF DESCRIPTION OF THE DRAWINGS

The invention is subsequently described based on embodiments with reference to drawing figures, wherein.

DETAILED DESCRIPTION OF THE INVENTION

Figure 1:
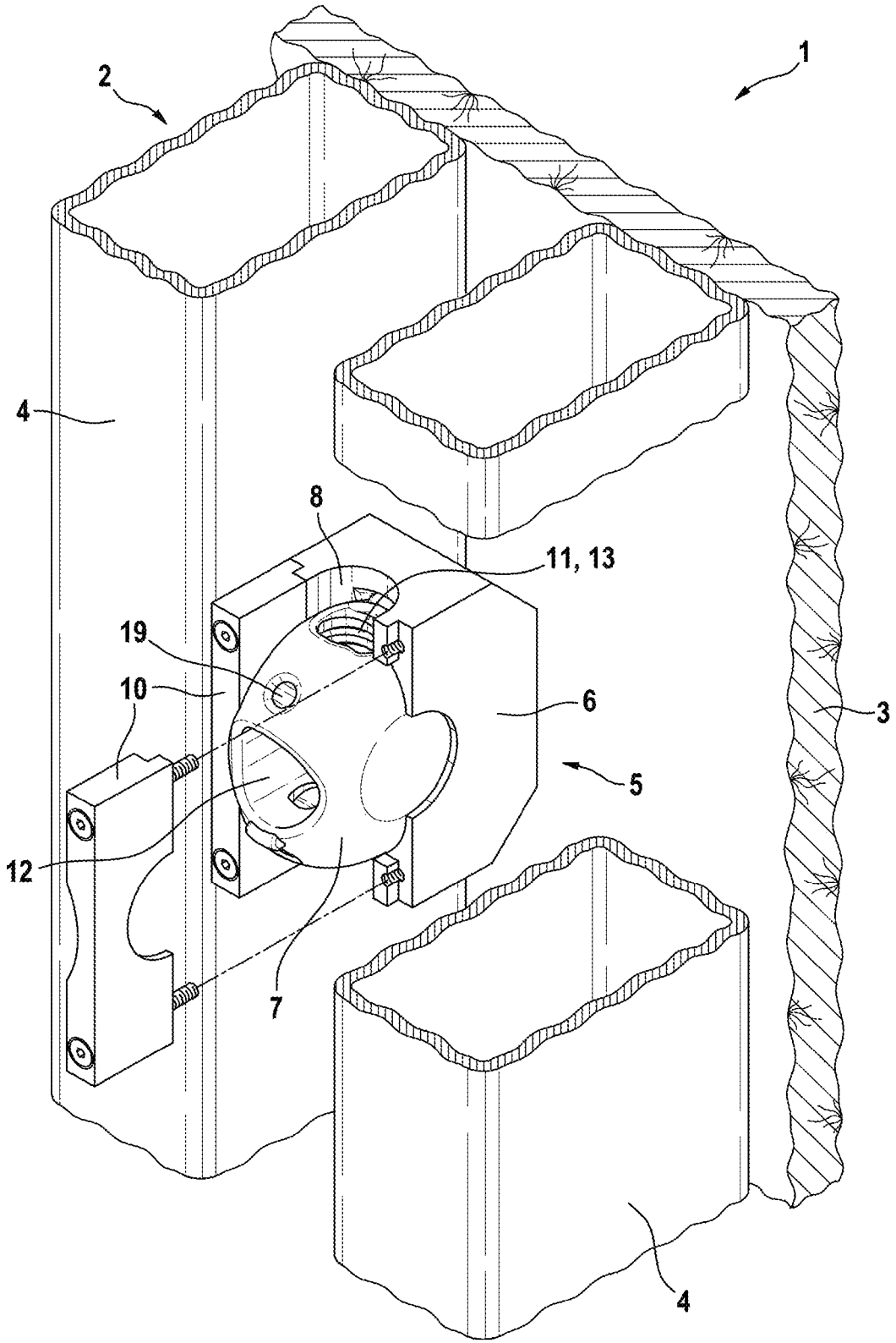
FIG. 1 illustrates a partial sectional view of a casing shell element according to the invention in a perspective view.

FIG. 1 illustrates a partial sectional view of a casing she element 1 according to the invention which is used for casing concrete: The casing shell element 1 includes a frame 2 on which a plate is arranged that is made for example from wood or plastic material that forms the casing shell 3. The frame 2 is a flat frame 2 made from rectangular metal tubes that are arranged in parallel and at right angles relative to each other forming struts 4. The frame 2 partially includes double struts 4 which means two struts 4 which are arranged in parallel with each other and which are arranged at a distance from each other which approximately corresponds to their width. Between two struts 4 of such double struts attachment devices 5 according to the invention are arranged wherein one of the attachment devices is drawn in FIGS. 1-3. The attachment devices 5 are arranged in a pattern distributed over the surface of the casing shell element 1 or of the casing shell 3. FIG. 1 illustrates a partial sectional view of one of the two struts 4 in the portion of the attachment device 5 so that it does not cover the attachment device 5. In an unillustrated embodiment of the invention, the attachment device 5 can also be arranged in one strut 4.

The attachment device 5 includes a reaction bearing 6 in which an anchor counter piece 7 is rotatably received. The reaction bearing 6 is block shaped and has the same width as the distance between the two struts 4 of the double strut. The reaction bearing 6 contacts the casing shell 3 and is attached at both struts 4, for example welded together with them or threaded together. The reaction bearing 6 includes a U-shaped groove 8 that is parallel to both struts 4 and parallel to the casing shell 3 in which groove the anchor counter piece 7 is inserted.

The anchor piece 7 is circular with a rounded circumferential surface in a side view transversal to the struts 4 of the frame 2 and parallel to the casing shell 3. The anchor counter piece is inserted so that it is rotatable about its axis in a congruent semi-circular receiver 9 with an identically cambered circumferential surface of the reaction bearing 6. The anchor counter piece 7 is supported by two bar shaped supports 10 which are arranged at sides of the reaction bearing 6 laterally from the groove 8 on a back side at the reaction bearing wherein the back side is oriented away from the casing shell 3. The supports 10 include semi-circular indentations that are congruent to the anchor counter piece 7 at insides of the supports that are oriented towards each other. The supports 10 can be for example bolted together with the reaction bearing 6. Another option are supports 10 made from plastic material which are interlocked with the reaction bearing 6 so that they can and have to be destroyed and replaced for an exchange of the anchor counter piece 7.

The anchor counter piece 7 includes pass through holes 11 12 intersecting at a right angle at a rotation axis of the anchor counter piece 7. The pass through holes 11, 12 are arranged at a plane that is perpendicular to the casing shell 3 and parallel to both struts 4. One of the two pass through holes 11 includes an inner thread for threading in a non-illustrated rod shaped anchor. The inner thread 13 is provided in particular for threading in a so called Dywidag rod as an anchor. The other pass through hole 12 is provided without a thread, however. a non-illustrated rod shaped anchor can be inserted through it and can be connected tension proof with the casing shell element by threading on a non-illustrated anchor nut on a back side of the attachment device 5 oriented away from the casing shell 3 or of the struts 4 of the frame 2. The pass through holes 11, 12 can be generally considered as different attachment facilities for identical or different anchors.

In a radial direction to the rotation axis of the anchor counter piece 7 and perpendicular to the casing shell 3, the casing shell 3 and the reaction bearing 6 include pass through holes which can also be considered as anchor holes 14, 15 for a pass through of a rod shaped anchor. Rotating the anchor counter piece 7 facilitates optionally aligning one of the pass through holes 11, 12 which form the different attachment facilities with the anchor holes 14, 15 in the casing shell 3 and with the reaction bearing 6. A non-illustrated anchor can be inserted from the outside of the casing shell through the anchor holes 14, 15 into the aligned pass through hole 11, 12 of the anchor counter piece 7 as well as from the back side through the pass through hole 11, 12 and the anchor holes 14, 15.

For rotating the anchor counter piece 7 includes two pass through holes 19 intersecting at a right angle in the rotation axis of the anchor counter piece, wherein the pass through holes are arranged at angles of 45° relative to the pass through holes 11, 12 forming the different attachment facilities for anchors and in a plane with these pass through holes 11, 12 in the anchor counter piece 7. The anchor counter piece 7 can be rotated for example with a pin, screw driver or small hammer which is inserted into one of the pass through holes 19 and optionally one of the pass through holes 11, 12 which form the different attachment facilities for an anchor can be aligned with the anchor holes 14, 15 in the casing shell 3 and with the reaction bearing 6.

Spring loaded ball bushing 16 are respectively threaded into one end of the pass through holes 11 and 12 used for turning the anchor counter piece 7 wherein the spring loaded bushings include balls 17 which are pressed outward under a spring load. When one of the two pass through holes 11, 12 which include the different attachment facilities for anchors is aligned with the anchor holes 14, 15 the balls 17 snap into recesses 18 in a circumference of the semi-circular receiver 9 for the anchor counter piece 7 in the reaction bearing 6. The spring loaded ball bushings 16 co-operating with the recesses 18 form snap locking devices which support the anchor counter piece 7 in the rotating positions in which the pass through holes 11, 12 which form the different attachment facilities for anchors are aligned with the anchor holes 14, 15 in the casing shell 3 and in the reaction bearing 6. These rotating positions of the anchor counter piece 7 can also be considered as operating positions of the anchor counter piece 7. In general the snap locking devices can also be considered as position securing devices which support the anchor opposite piece in the rotating positions or in the operating positions. Other position securing devices for the operating positions of the anchor counter piece 7 are feasible, for example a manually operable locking bar or a similar locking element (not illustrated).

Figure 3:
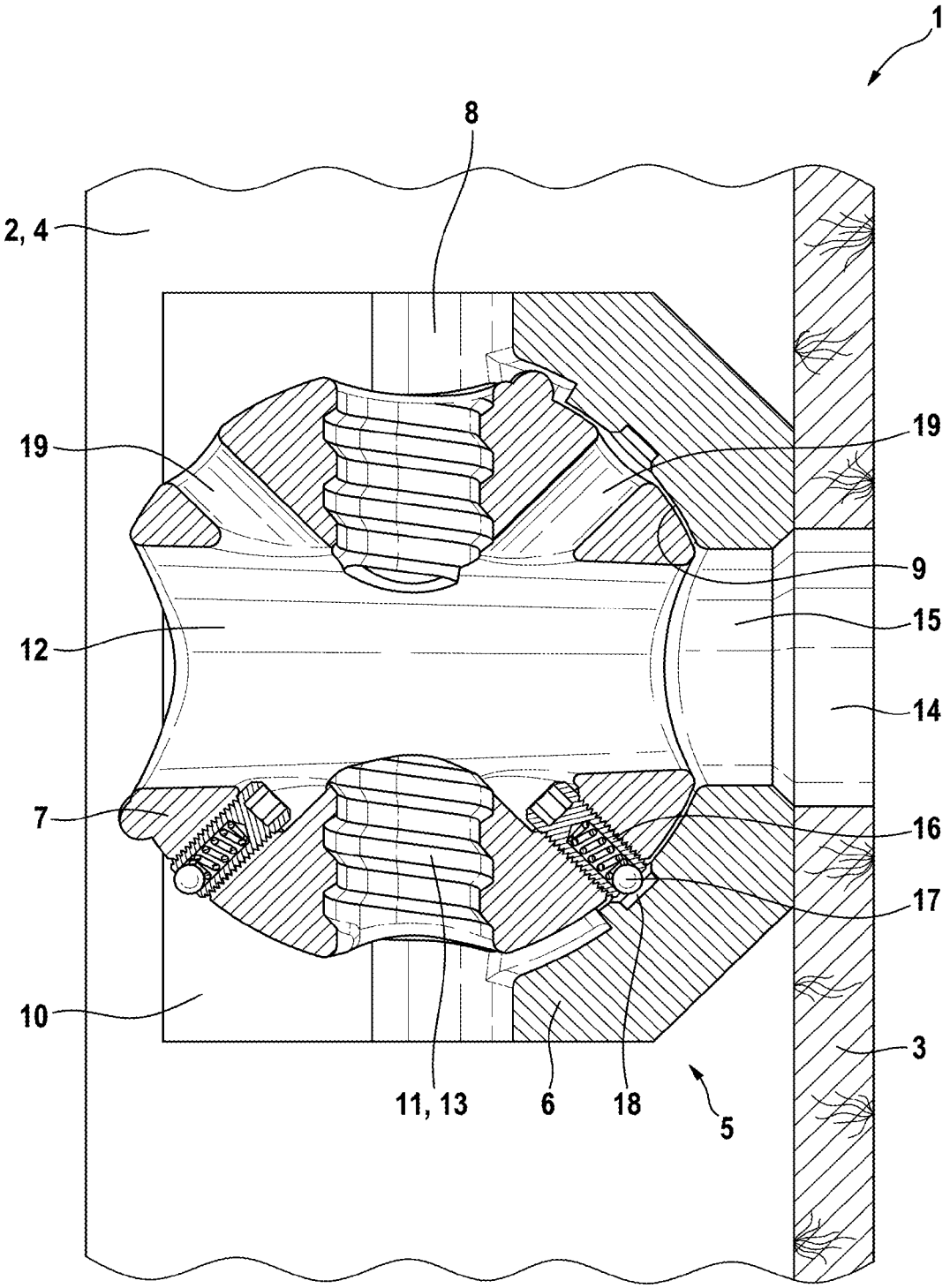
FIG. 3 illustrates the attachment device of FIG. 2 in another operating position.
Figure 4:
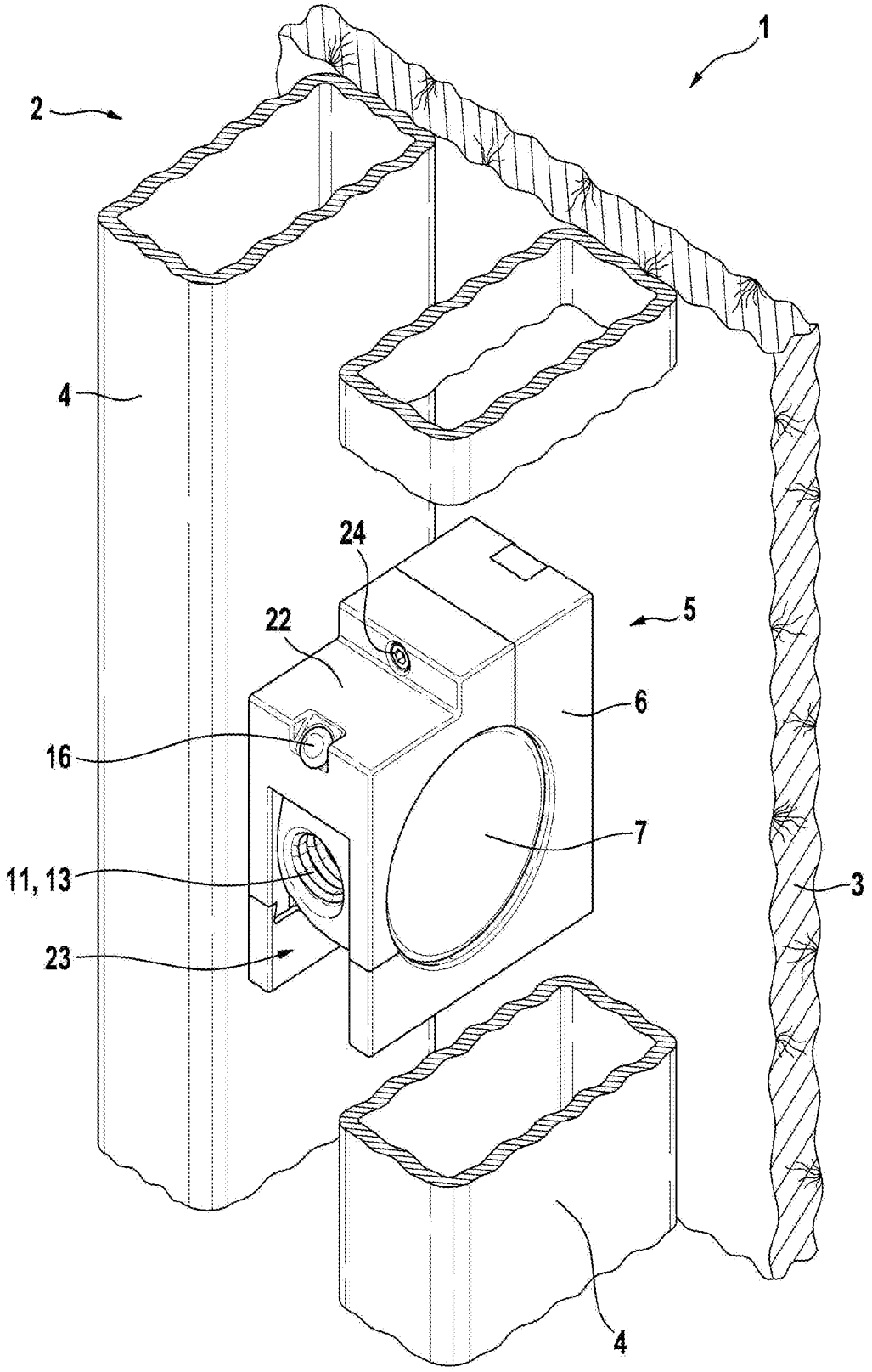
FIG. 4 illustrates a partial sectional view of a casing shell element with a modified attachment device according to the invention in a perspective view corresponding to FIG. 1.

In Fig. 4 the anchor counter piece 7 has the shape of a symmetrical ball zone and contacts a congruent receiver of the reaction bearing 6. Thus, the anchor counter piece 7 is not only pivotable about its axis but pivotable like a ball joint in all directions. By rotating about its axis the anchor piece of FIG. 4 is pivotable into operating positions as evident from FIGS. 1-3 in which optionally a pass through hole 11, 12 of the pass through holes 11 12 intersecting each other and the axis of the anchor counter piece is aligned with an anchor hole 14 in a casing shell of a casing shell element 1 in order to be able to fixate a non-illustrated anchor in a disengageable manner. By providing pivotability transversal to the axis the anchor counter piece 7 of FIG. 4 compensates angular alignment deviations.

Figure 5:
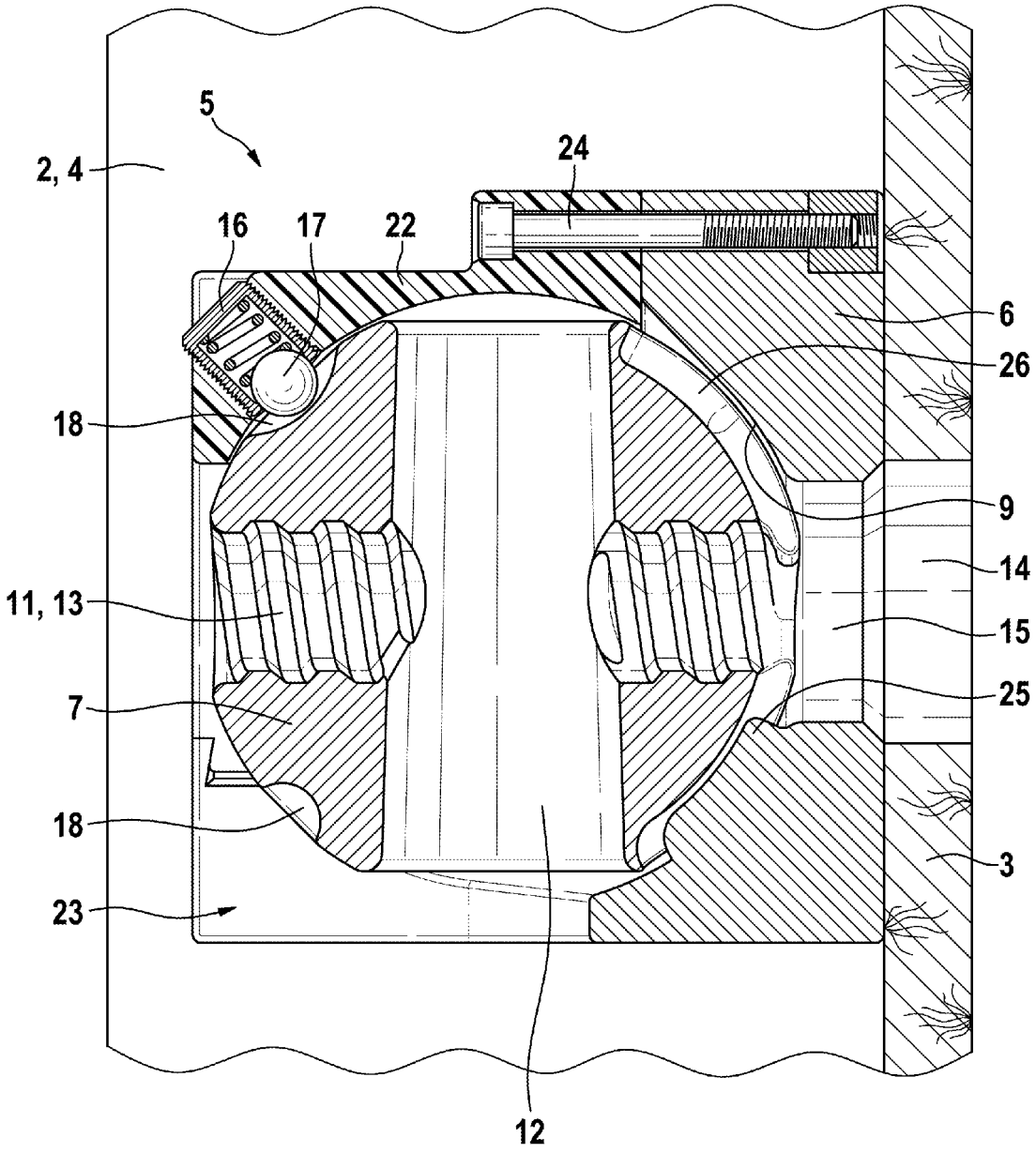
FIG. 5 illustrates a cross section of the attachment device in FIG. 4 in an operating position.
Figure 6:
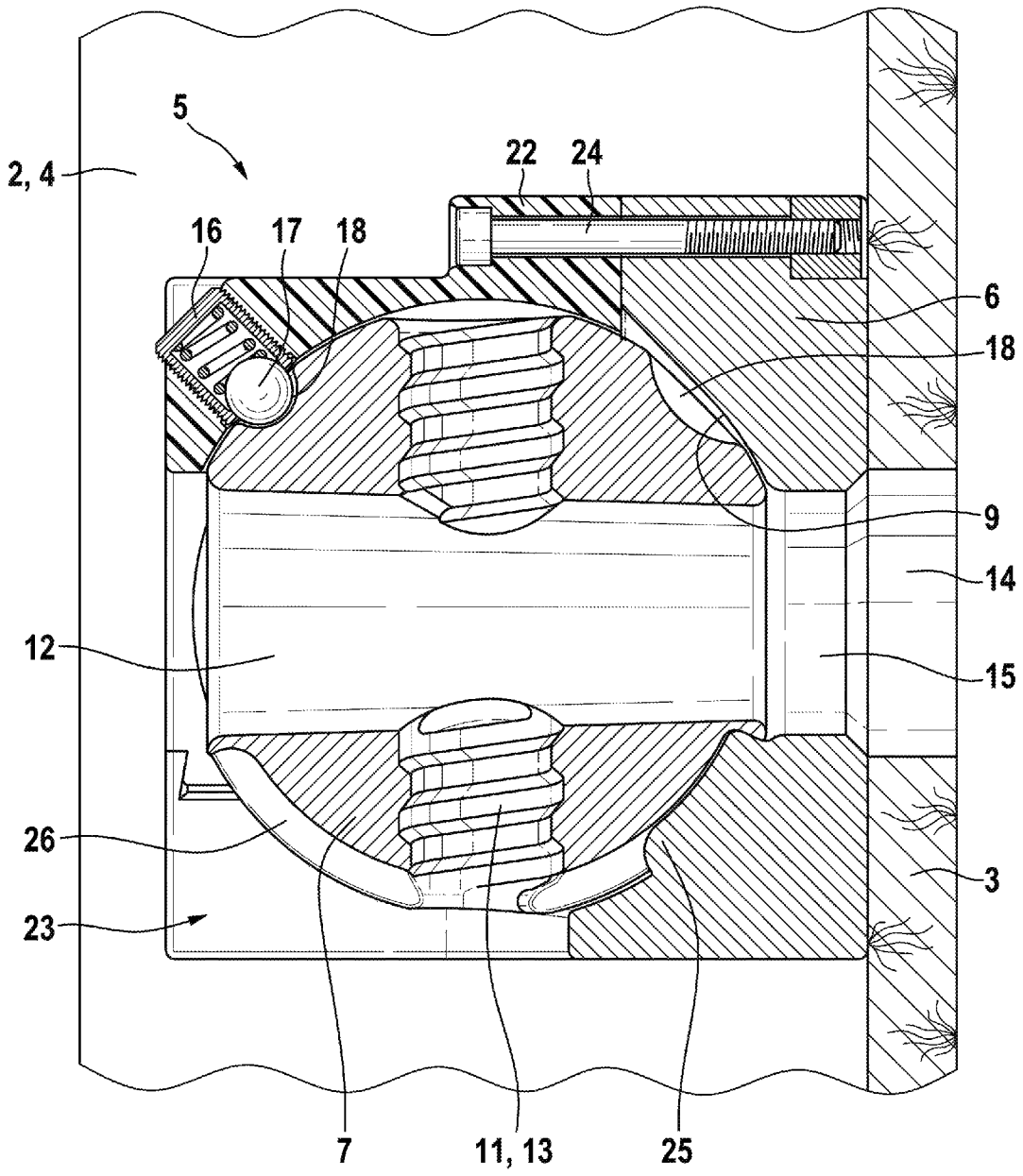
FIG. 6 illustrates the attachment device of FIG. 5 in another operating position.

As illustrated in FIGS. 5 and 6 one of the pass through holes 11 includes an inner thread 13 for threading in a so called Dywidag-rod forming an anchor and the other pass through hole 12 is configured without a thread for passing an anchor through which is fixated for example by an anchor nut on a back side of the attachment device 5 oriented away from the casing shell 3 or by struts 4 of the casing shell element 1.

FIGS. 4-6 lack the pass through holes that are arranged at an angle of 45°, the anchor counter piece 7 is for example rotated by a rod, screw driver, anchor or small hammer that is inserted into the pass through holes 11, 12. A cover 22 which is attached at the reaction bearing 6 instead of the supports 10 and which supports the anchor counter piece 7 rotatably in all directions in the receiver 9 of the reaction bearing 6 and the reaction bearing 6 include an opening 23 which extends over slightly more than 90° so that the pass through holes 10, 11 are accessible in both operating positions and so that the anchor counter piece 7 is rotatable. The cover 22 is closed on top in order to protect the anchor counter piece 7 against contamination. "On top" refers to a position of the attachment device 5 when the casing shell element is set up for pouring concrete as intended. The cover 22 is fixated with a bolt 24 at the reaction bearing and interlocked at two other locations. The cover 22 is removable after the screw 24 is disengaged.

The reaction bearing 6 includes a rib 25 in the receiver 9 for the anchor counter piece 7, wherein the rib extends in a rotation direction of the anchor counter piece 7, wherein the rib engages a groove 26 which extends in the anchor counter piece 7 also in the rotation direction of the anchor counter piece 7. The rib 25 engaging the groove 26 supports the anchor counter piece 7 so that it is rotatable about its axis. At one end the groove 26 is as wide as the rib 25 so that the anchor counter piece 7 is not pivotable transversal to the axis when the rib 25 is arranged in this portion of the groove 26. At the other end the groove 26 is wider than the rib 25 so that the anchor counter piece 7 is pivotable sideways for compensating angular alignment deviations of an anchor with a pivot angle of for example 5° towards both sides. The rib 25 is arranged in a wide portion of the groove 26 when the pass through hole 11 of the anchor counter piece 7 including the interior thread 13 is aligned with the anchor hole 14 in the casing shell 3 so that an angular alignment deviation of an anchor that is threaded into the pass through hole 11 is compensated. When the unthreaded pass through hole 12 of the anchor counter piece 7 is aligned with the anchor hole 14 in the casing shell 3 the rib 25 does not have any clearance in the groove 26.

Figure 2:
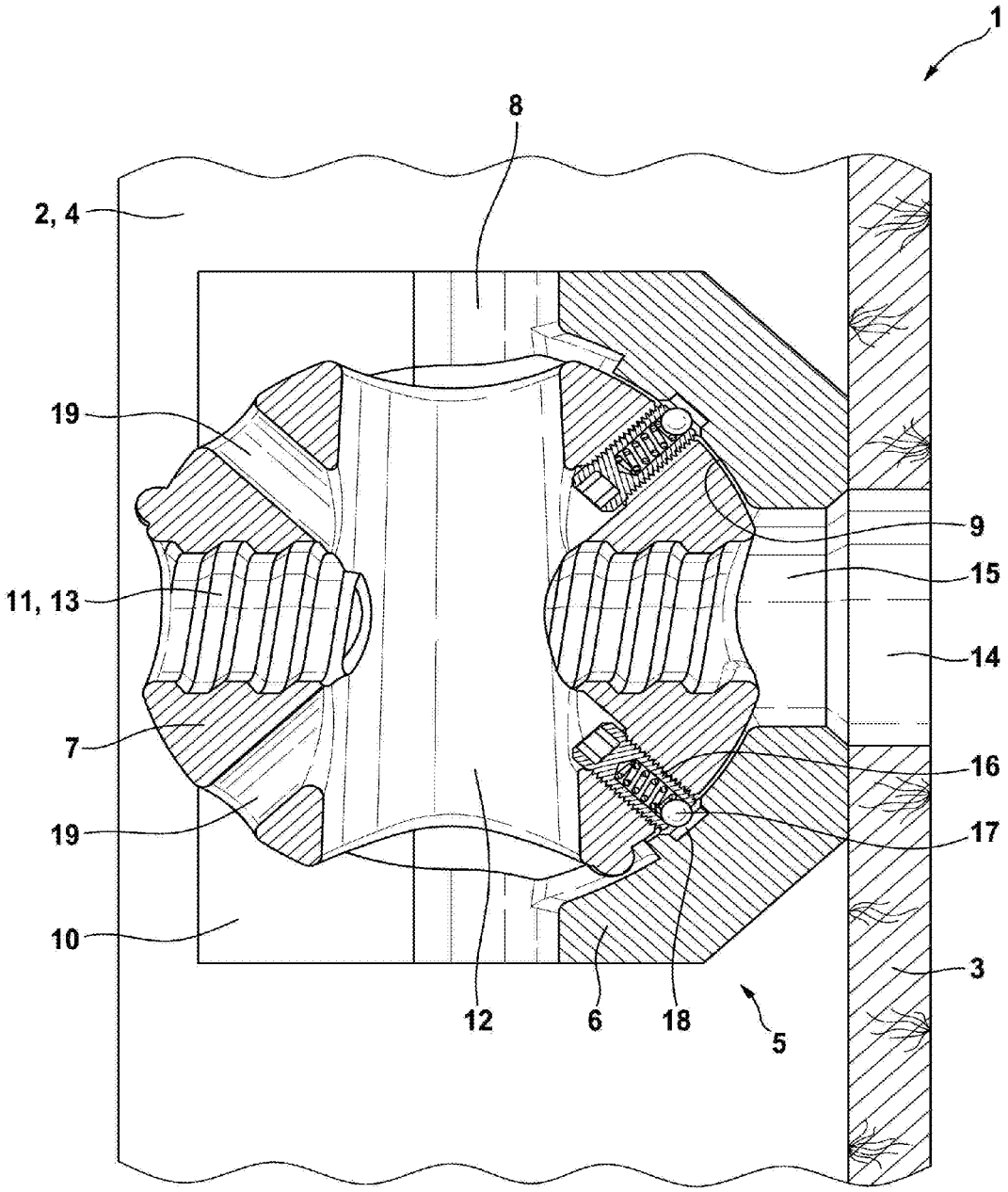
FIG. 2 illustrates a cross section of an attachment device of the casing shell element of FIG. 1 in an operating position.

FIGS. 4-6 illustrate a spring loaded ball bushing 16 that is arranged in the cover 22 instead of being arranged in the anchor counter piece 7. The spring loaded ball bushing could also be arranged in the reaction bearing. The ball ball 17 of the spring loaded ball bushing 16 interacts with two ball shaped bevels 18 in the circumference of the anchor counter piece 7 and supports the anchor counter piece 7 in the two operating positions. The recesses (18) can also have another shape; they can be, for example, conical in shape (not illustrated). For example conical bevels facilitate a support without clearance of the anchor counter piece 7 in the operating positions without compensating movements for balancing angular misalignments. The bevel 18 in which the ball 17 is arranged when the pass through hole 11 including the internal thread 13 of the anchor counter piece 7 is aligned with the anchor hole 14 in the casing shell 3 is larger and deeper so that a clearance in the direction of rotation of the anchor counter piece 7 and transversal to the rotation direction is provided for compensating angular alignment deviations. A spring loading of the sphere 17 of the spring loaded ball bushing 16 towards the base of the bevel 18 causes an aligned orientation of the pass through hole 11 of the anchor counter piece 7 with the anchor hole 14 in the casing shell 3. A deflection of the anchor counter piece 7 is provided against a spring force of the spring ball bushing 16. As illustrated in FIGS. 1-3 the spring ball bushing 16 and the bevel 18 form a snap locking device or generally a position securing device which supports the anchor counter piece 7 in the operating positions.

Additionally the attachment device 5 of FIGS. 4-6 is configured identical and functions in the same manner as the attachment device illustrated in FIGS. 1-3 so that the descriptions of FIGS. 1-3 can be referred to in order to describe FIGS. 4-6 in order to avoid repetition. Identical components have identical reference numerals.

Figure 7:
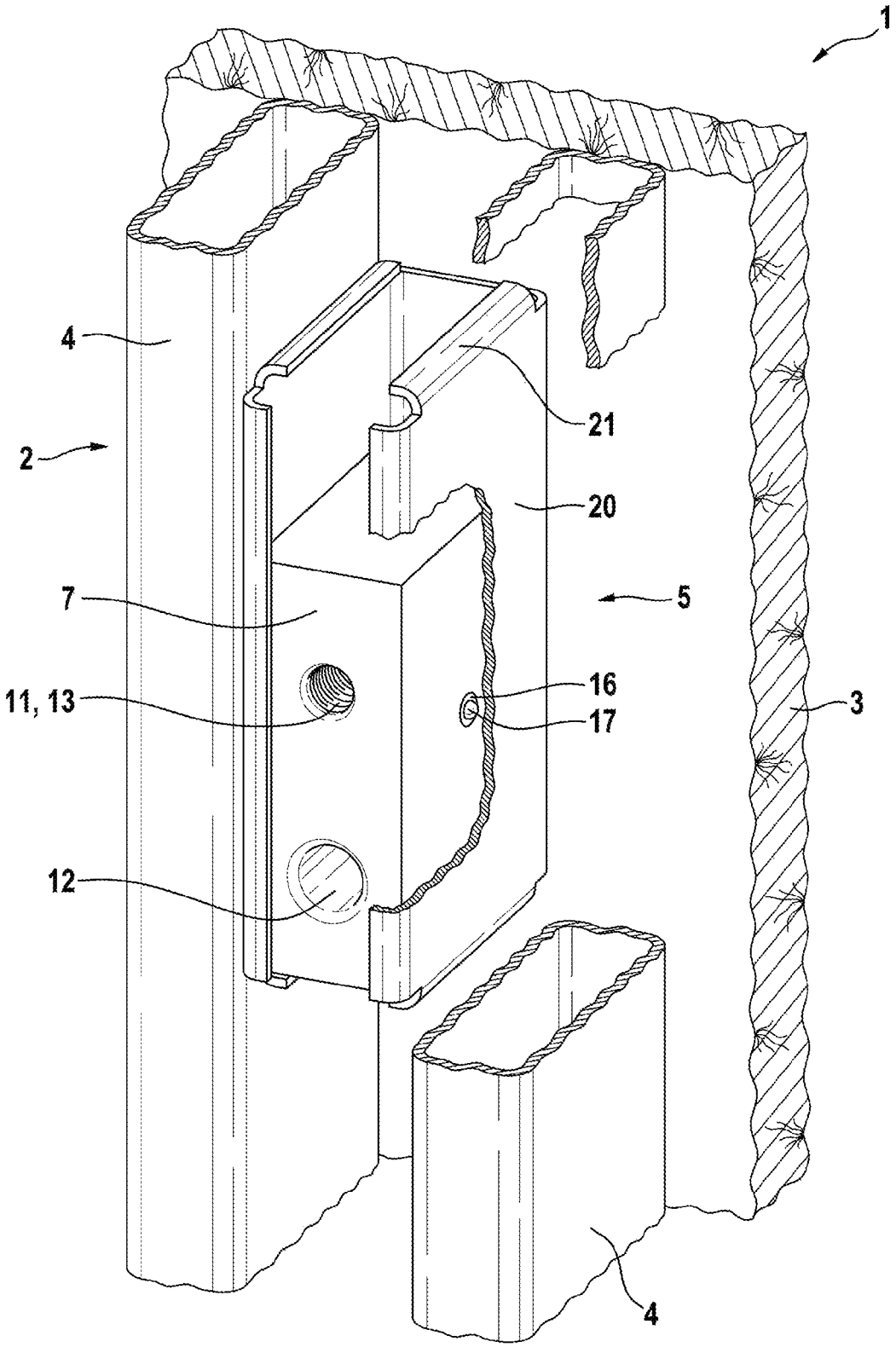
FIG. 7 illustrates a third embodiment of a casing shell element with an attachment device according to the invention in an illustration corresponding to FIG. 1.

FIG. 7 illustrates a casing shell element 1 with a modified attachment device 5. Identical reference numerals are used for components in FIG. 7 that are identical with components in FIGS. 1-3 in the subsequent description. The attachment device 5 in FIG. 7 is also arranged between two struts 4 of a double strut of a frame 2 of the casing shell element 1. An anchor counter piece 7 is cuboid and movable in a longitudinal direction of the struts 4 instead of being rotatable. The attachment device 5 includes a sliding support 20 for the anchor counter piece 7 wherein the sliding support is shaped as a rectangular tube that is open on one side and which is for example bolted together or welded together with the struts 4. The open side of the sliding support 20 is arranged on a back side of the casing shell element 1, thus it is oriented away from the casing shell 3. An inner cross section of the sliding support 20 corresponds with a cross section of an anchor counter piece 7, so that the anchor counter piece 7 is slideably supported in the sliding support 20. The sliding support 20 includes inward bent lobes 21 at respective ends wherein the lobes limit a movement path of the anchor counter piece 7 and support the anchor counter piece 7 in the sliding support 20.

The anchor counter piece 7 includes two pass through openings 11, 12 that are parallel to each other. As illustrated in FIGS. 1-3 a pass through hole 1 includes an inner thread 13 for threading in a threaded non-illustrated anchor and the other pass through opening 12 is configured without a thread for passing an anchor through. The two pass through holes 11, 12 of the movable anchor counter piece 7 of FIG. 7 form different attachment facilities for anchors like the pass through holes 11, 12 in FIGS. 1-3.

In end positions of the anchor counter piece 7 in which the anchor counter piece 7 contacts inward bent lobes 21 of the sliding support 20 one respective pass through hole 11, 12 which form the respective attachment facilities for the anchor is aligned with an anchor hole that is not visible in FIG. 7 which extends through the casing shell 3 and the sliding support 20 so that a non-illustrated anchor is insertable through the casing shell 3 into the respective pass through hole 11, 12 of the anchor counter piece 7 or vice versa from the back side of the casing shell element 1 through the respective pass through hole 11, 12 of the anchor counter piece 7 through the anchor hole in the sliding support 20 and in the casing shell 3.

At one side surface the anchor counter piece 7 includes a spring loaded ball bushing 16 whose ball 17 is pressed outward by a spring against an inside of a side wall of the sliding support 20. In the side wall of the sliding support 20, two bevels are arranged that are not visible in the drawing wherein the ball 17 snaps into the bevels in end positions of the anchor counter piece 7. The end positions of the anchor counter piece 7 are operating positions in which as described one of the respective pass through openings 11, 12 which form the different attachment facilities for the anchor is aligned with the anchor hole in the sliding support 20 and in the casing shell 3 so that it is useable for connecting an anchor with the attachment device 5 of the casing shell element 1. Also here the spring loaded ball bushing 16 and the bevel form a snap locking device or generally a position securing device which supports the anchor counter piece 7 in the operating positions.

For compensating angular misalignments, the anchor counter piece 7 can have one or plural unillustrated convex and/or arcuate outer surfaces and an unillustrated clearance in the sliding support 20 so that the anchor counter piece 7 is pivotable about its longitudinal axis and/or transversal axis.

As a matter of principle, the anchor counter piece 7 can also include only one pass through hole 11. Advantageously an unillustrated pass through hole 11 which includes the inner thread 13, can be movable in a sideways direction by the movability of the anchor hole 14 in the casing shell 3 so that either the pass through hole 11 with the inner thread 13 is useable for threading an anchor in or the anchor hole 14 without the anchor counter piece 7 is useable for inserting an anchor past the anchor counter piece 7. This option is also provided when the anchor counter piece 7 includes plural pass through holes 10, 11. Also, with a pivotable attachment of an anchor counter piece 7 at the casing shell element 1, it is possible to move the anchor counter piece 7 from the anchor hole 14 in the casing shell 3 sideways so that an unillustrated anchor is insertable past the anchor counter piece 7 through the anchor hole 14, Moving the anchor counter piece 7 sideways includes a movement in upward or downward direction. Of particular importance is the option to be able to insert an anchor past the anchor counter piece 7 through the anchor hole 14 in the casing shell 3.

What is claimed is:

1. A casing shell element for casing concrete, the casing shell element comprising:

a casing shell which is arranged at a frame and which includes an anchor hole configured for inserting an anchor; and an anchor counter piece providing a disengageable and tension proof connection of the anchor with the casing shell element, wherein the anchor counter piece is movably attached at the casing shell element and includes at least one attachment facility for the anchor, wherein at least one attachment facility is movable into an operating position by moving the anchor counter piece, wherein the anchor runs through the anchor hole and is connectable in a disengageable manner with the anchor counter piece in the operating position of the attachment facility, wherein the anchor counter piece includes plural different attachment facilities for the anchor, wherein the attachment facilities are moveable into an operating position by moving the anchor counter piece, and wherein the anchor is connectable with the attachment device in the operating position in a disengageable manner and runs through the anchor hole.

2. A casing shell element for casing concrete, the casing shell element comprising:

a casing shell which is arranged at a frame and which includes an anchor hole configured for inserting an anchor; and an anchor counter piece providing a disengageable and tension proof connection of the anchor with the casing shell element, wherein the anchor counter piece is movably attached at the casing shell element and includes at least one attachment facility for the anchor, wherein the at least one attachment facility is movable into an operating position by moving the anchor counter piece, wherein the anchor runs through the anchor hole and is connectable in a disengageable manner with the anchor counter piece in the operating position of the attachment facility, wherein the anchor counter piece is pivotably arranged at a casing shell element, and wherein the anchor counter piece includes attachment facilities intersecting each other at a pivot axis of the anchor counter piece.

3. A casing shell element for casing concrete, the casing shell element comprising:

a casing shell which is arranged at a frame and which includes an anchor hole configured for inserting an anchor; and an anchor counter piece providing a disengageable and tension proof connection of the anchor with the casing shell element, wherein the anchor counter piece is movably attached at the casing shell element and includes at least one attachment facility for the anchor, wherein the at least one attachment facility is movable into an operating position by moving the anchor counter piece, wherein the anchor runs through the anchor hole is connectable in a disengageable manner with the anchor counter piece in the operating position of the attachment facility, and wherein the anchor counter piece includes an attachment facility with an internal thread and an unthreaded attachment facility.

4. A casing shell element for casing concrete, the casing shell element comprising:

a casing shell which is arranged at a frame and which includes an anchor hole configured for inserting an anchor; and an anchor counter piece providing a disengageable and tension proof connection of the anchor with the casing shell element, wherein the anchor counter piece is movably attached at the casing shell element and incudes at least one attachment facility for the anchor, wherein the at least one attachment facility is movable into an operating position by moving the anchor counter piece, wherein the anchor runs through the anchor hole and is connectable in a disengageable manner with the anchor counter piece in the operating position of the attachment facility, and wherein an attachment device attaches the anchor counter piece in a movable manner at the casing shell, wherein the attachment device does not protrude beyond the frame on a backside of the casing shell element which backside is oriented away from the casing shell.

* * * * *